United States Patent [19]

Takayama

[11] Patent Number: 4,663,846

[45] Date of Patent: May 12, 1987

[54] CUTTER HAVING A RETRACTABLE AND REMOVABLE BLADE

[75] Inventor: Ryuji Takayama, Nagano, Japan

[73] Assignee: Takayama Sangyo Co. Ltd., Japan

[21] Appl. No.: 876,719

[22] Filed: Jun. 20, 1986

[30] Foreign Application Priority Data

Aug. 14, 1985 [JP] Japan ..... 60-125281[U]

[51] Int. Cl.[4] ..... B26B 1/08

[52] U.S. Cl. ..... 30/162; 401/67

[58] Field of Search ..... 30/162, 329, 335, 337, 30/342; 401/94, 109, 112–114, 67

[56] References Cited

U.S. PATENT DOCUMENTS

| | | | |
|---|---|---|---|
| 3,814,524 | 6/1974 | Sperti | 401/67 X |
| 3,855,700 | 12/1974 | Gerson et al. | 30/162 |
| 4,337,576 | 7/1982 | Drost et al. | 30/162 |
| 4,343,558 | 8/1982 | Fujiwara | 401/67 |

*Primary Examiner*—Douglas D. Watts
*Attorney, Agent, or Firm*—Fred A. Keire

[57] ABSTRACT

A blade is removably supported on one end of a shank which is axially movably disposed in a tubular holder. The shank has an axially extending slit terminating at the end thereof for supporting the blade therein and a tapered portion having an outside diameter decreasing gradually from the end of the shank. The blade is movable from one of its retracted, cutting and replacement positions to another with the movement of the shank. A sleeve is fitted about the shank adjacent to the end thereof and has one end facing the tapered portion thereof. A coiled spring is provided on the shank for urging one end of the sleeve into contact with the tapered portion of the shank. The sleeve is axially movable with the movement of the shank. The holder is provided on its inner surface adjacent to the sleeve for preventing the movement of the sleeve upon movement of the blade to its replacement position.

5 Claims, 14 Drawing Figures

CUTTER HAVING A RETRACTABLE AND REMOVABLE BLADE

BACKGROUND OF THE INVENTION

1. Field of the Invention

This invention relates to a cutter having a retractable blade supported on one end of a shank which is axially movable in a holder.

2. Description of the Prior Art

The most basic form of a cutter has a naked blade attached to one end of a handle. The naked blade is dangerous when the cutter is not used. This is particularly the case when the cutter is carried about. The naked blade also has the disadvantage of being easily damaged.

There is known a cutter having a vinyl tube or similar cover which can be placed over a blade. The cover is, however, very likely to be broken by the blade. It is also very likely that the cover may be lost.

These problems can be solved by a cutter having a retractable blade. This cutter has a part which can be pressed or turned to push out the blade or draw it back. The blade is actuated by a mechanism which is similar to that employed by a mechanical pencil or a ballpoint pen for moving its lead or ball. The blade requires a sufficiently strong support for withstanding the force to which it is subjected when the cutter is used. The blade support is usually a molded product of a synthetic resin. One end of the blade is fixed in the molded support and the blade is movable out of, or back into, a holder when a push-button is pressed. The blade and its support form a unitary assembly which has to be changed completely when it is necessary to change the blade. The replacement of the blade is, therefore, expensive. Moreover, it is necessary to remove a cap from the tip of the holder when changing the blade.

SUMMARY OF THE INVENTION

Under these circumstances, it is an object of this invention to provide a cutter having a retractable blade which can be reliably held in position even if it may be subjected to a considerably large force when the cutter is used, and which is easy to change.

This object is attained by a cutter comprising a holder, a shank disposed in the holder movably axially of the holder, a blade which is removably supported on one end of the shank and is movable between its cutting position and its retracted position with the movement of the shank, the shank having an axially extending slit terminating at the one end thereof for supporting the blade therein and a tapered portion having an outside diameter decreasing gradually from the one end of the shank, a sleeve fitted about the shank adjacent to the one end thereof, a coiled spring or similar means provided on the shank for urging one end of the sleeve into contact with the tapered portion, the sleeve being axially movable with the movement of the shank, and a member provided about the one end of the shank for preventing the movement of the sleeve upon projection of the blade to its cutting position.

The shank is movable between three positions, i.e., the first position in which the blade is retracted into the holder, the second position in which the blade is projected from the holder, and the third position in which the sleeve is prevented from any further movement upon projection of the blade. When the shank is in its first or second position, the sleeve is urged against the tapered portion by the coiled spring or similar means and exerts pressure on the tapered portion. This pressure acts in a direction in which the slit is closed so that the shank may firmly grip the blade. Therefore, the blade can reliably withstand the force to which it is subjected when the cutter is used.

When the shank is moved to its third position, its tapered portion is moved, but the sleeve is not moved. The sleeve is separated from the tapered portion and does no longer exert any pressure on the tapered portion. As a result, the blade is no longer held in the slit tightly, but is easy to remove therefrom.

Either of two mechanisms can, for example, be used for moving the shank from its first to third position. One of them is a mechanism for pressing the shank and the other is a mechanism for turning it. Both of them are similar to the mechanisms which are already employed in, for example, ballpoint pens.

BRIEF DESCRIPTION OF THE DRAWINGS

FIG. 2(*b*) is an end view of the holder;

FIG. 4(*b*) is an end view of the shank;

FIG. 4(*c*) is a top plan view of the shank;

FIG. 5(*b*) is a longitudinal sectional view of a sleeve;

DETAILED DESCRIPTION OF THE INVENTION

Figure 1:
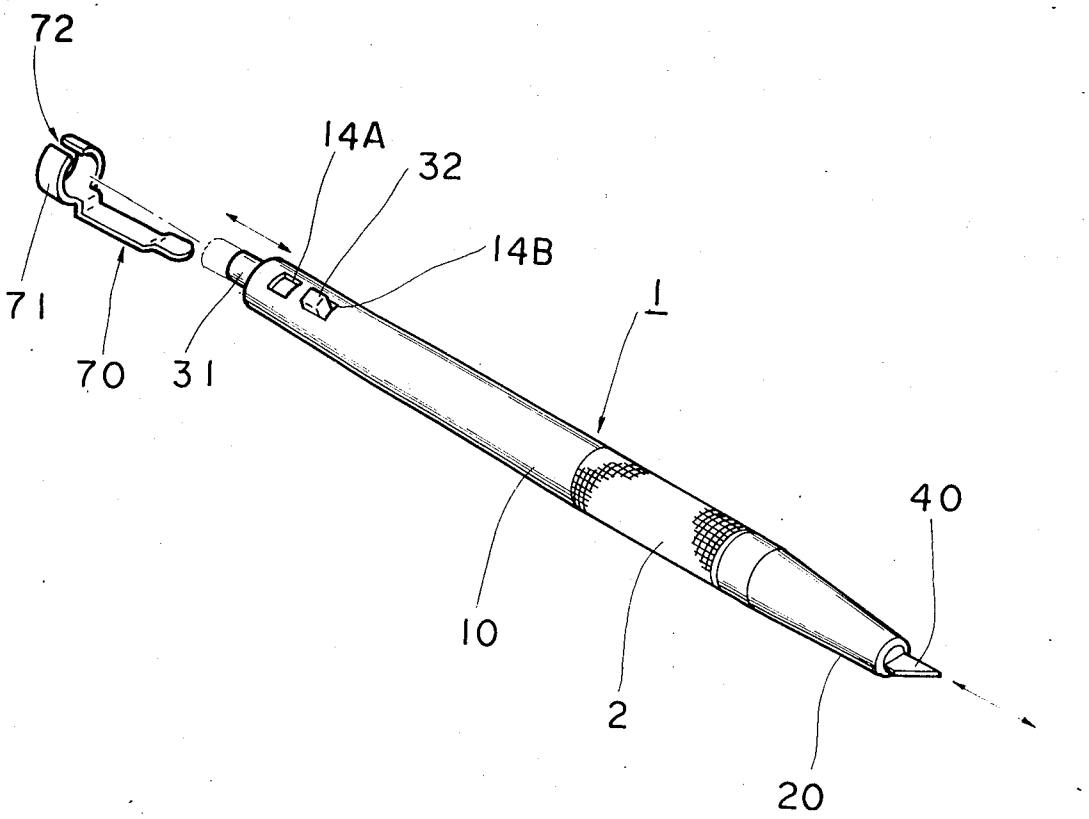
FIG. 1 is a perspective view of a cutter embodying this invention.

A cutter embodying this invention is shown by way of example in the drawings. It includes a holder 1 comprising a main body 10 and a cap 20 which is removably connected to the main body 10. The holder 10 has a portion covered with rubber 2. A shank 30 is axially movably disposed in the holder 1 and has one end on which a blade 40 is supported. The other end of the shank 30 defines a pushbutton 31. The main body 10 of the holder 1 has a wall provided with a first aperture 14A and a second aperture 14B. The shank 30 has a projection 32 which can project through either of the apertures 14A and 14B, depending on the position of the pushbutton 31 when it is pressed. The cutter also includes a clip 70 having an annular portion 71 which can be fitted about the main body 10 of the holder 1. The annular portion 71 has a slit 72 which is aligned with the first aperture 14A when the clip 70 is positioned about the holder. The slit 72 facilitates the manufacture of the clip 70 and its positioning about the holder.

Figure 2A:
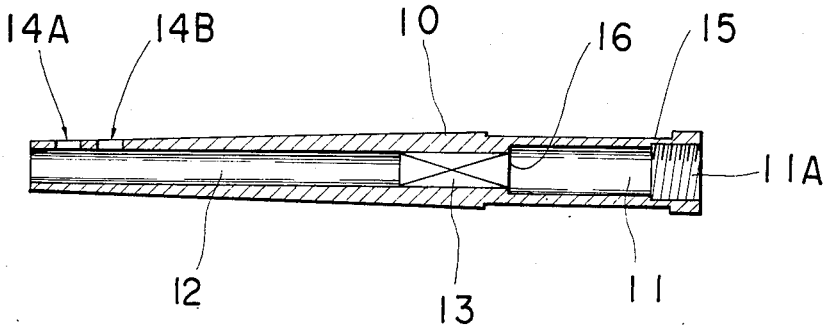
FIG. 2(*a*) is a longitudinal sectional view of a holder.
Figure 2B:
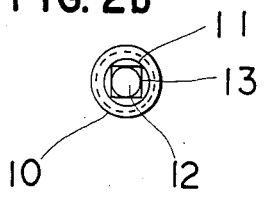

The main body 10 of the holder is a tubular body having a first end portion 11, a second end portion 12 and a middle portion 13, as shown in FIGS. 2(*a*) and 2(*b*). The first end portion 11 has an axial bore with a circular cross-section. The second end portion 12 also has an axial bore with a circular cross-section, but its bore is smaller in diameter than that of the first end portion 11. The middle portion 13 has an axial bore with a square cross-section. The first end portion 11 has a threaded inner surface llA adjacent to its outer end. The apertures 14A and 14B are provided in the second end portion 12. The body 10 has on its outer surface an annular groove 15 encircling the greater part of the first end portion 11 and a part of the middle portion 13. The rubber 2 is fitted in the groove 15. The body 10 has a generally annular shoulder 16 formed on its inner surface between the first end portion 11 and the middle portion 13.

Figure 3:
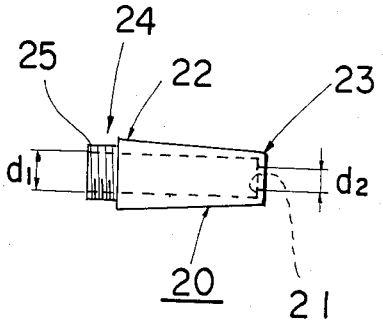
FIG. 3 is a front elevational view of a cap.

The cap 20 is a tubular member having a tapered outer surface, as shown in FIG. 3. It has an outside diameter which gradually decreases from its base end 22 to its free end 23. At its base end 22, its outside diameter is equal to the outside diameter of the main body 10 of the holder. The cap 20 has an inside diameter which is equal throughout substantially its entire length, as shown at $d_1$. The cap 20 has an annular shoulder 21 on its inner surface adjacent to its free end 23 and its free end 23 has, therefore, an inside diameter $d_2$ which is slightly smaller than the inside diameter $d_1$ of its remaining portion. The shoulder 21 is provided for preventing the axial movement of a sleeve 50 under certain circumstances, as will hereinafter be described. The cap 20 has adjacent to its base end 22 a threaded outer surface 24 which is engageable with the threaded inner surface llA of the main body 10.

Figure 4A:
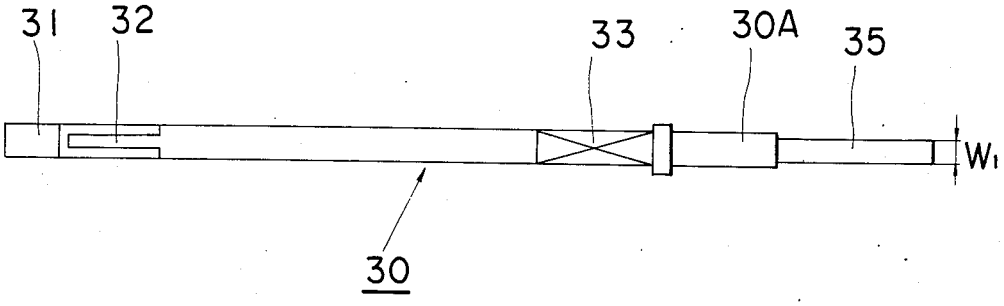
FIG. 4(*a*) is a front elevational view of a shank.
Figure 4B:
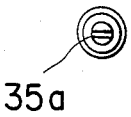
Figure 4C:
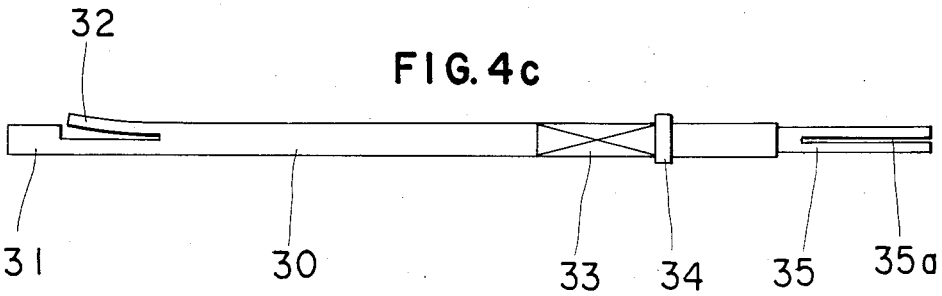
Figure 5:
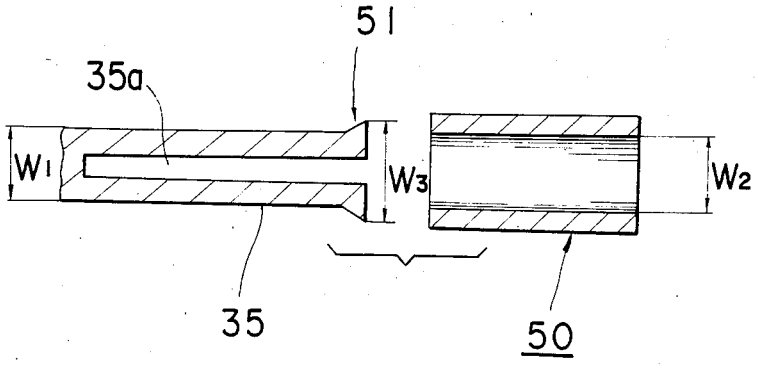
FIG. 5(*a*) is a longitudinal sectional view of a portion of the shank by which a blade is supported.

The shank 30 has a first end portion 35 for supporting the blade 40 thereon, a second end portion in which the pushbutton 31 and the projection 32 are provided, and a middle portion 30A. The shank 30 has a circular cross-section along the greater part of its length so that it may be snugly fitted in the holder, but its middle portion 30A has a middle part 33 with a square cross-section which is complementrry to the bore of the middle portion 13 of the body 10 of the holder. The shank 30 is provided at one end of the middle part 33 with a diametrically enlarged portion 34 which is engageable with the shoulder 16 of the body 10 of the holder. The shank 30 can be inserted into the body 10 of the holder if its second end portion, which is provided with the pushbutton 31, is inserted through the first end portion 11 of the body lu. The first end portion 35 of the shank 30 has a diameter which is substantially equal to the width of the blade 40. The first end portion 35 is axially provided with a blade supporting slit **35*a* extending along the greater part of its length and having a width which is equal to the diameter of the first end portion 35, as shown in FIGS. 4(*b*) and 4(*c*). The slit 35*a* is also open at the free end of the first end portion 35. The first end portion 35 has an cqual diameter substantially along its entire length, but is formed with a tapered projection 51 adjacent to its free end, as shown in FIG. 5(*a*). The tapered projection ol has its maximum diameter $W_3$ at the free end of the first end portion 35 and a minimum diameter $W_1$ that is equal to tne diameter of the remainder of the portion 35**.

Figure 6:
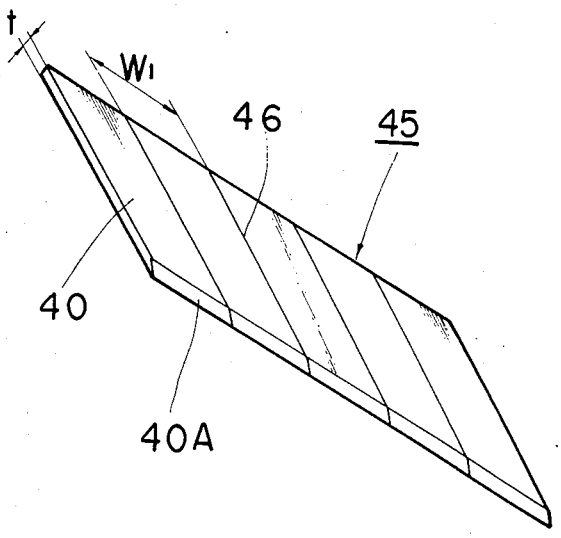
FIG. 6 is a perspective view of a set of blades.

The blade 40 has a cutting edge 40A at one end thereof. The cutter is usually supplied with a set of blades 40 formed from a single sheet or material 45, as shown in FIG. 6. They can be separated from one another along splitting lines 46. Each blade 40 has a thickness t which is substantially equal to the thickness of the slit **35*a* and a width $W_1$ which is substantially equal to that of the slit 35*a***.

Figure 7:
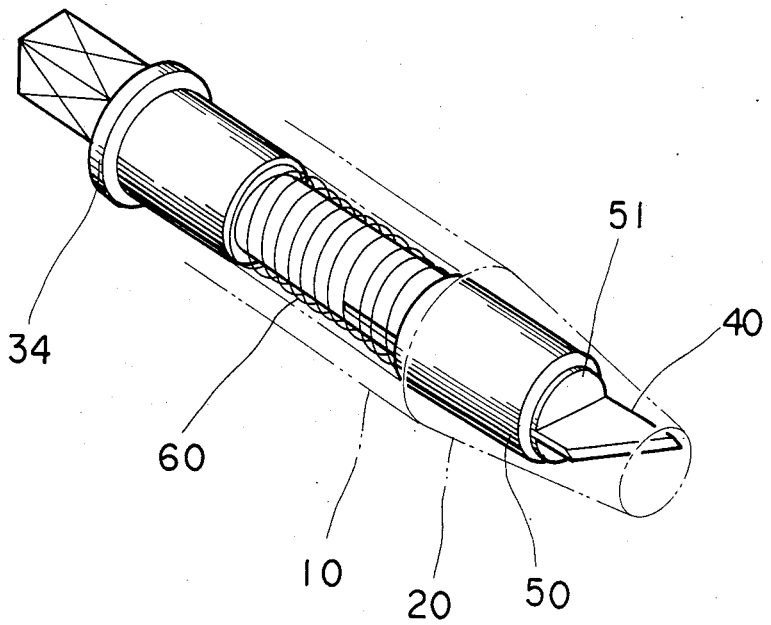
FIG. 7 is a fragmentary perspective view of cutter showing a blade held by the shank portion and the sleeve.

The blade 40 can be held firmly in the slit **35*a* by means of the sleeve 50, as shown in FIG. 7. The sleeve 50 is a hollow cylinder having an inside diameter $W_2$ which is slightly larger than the diameter $W_1$ of the first end portion 35 of the shank, as shown in FIGS. 5(*a*) and 5(*b*), so that the shank portion 35 and the sleeve 50 may be slidable relative to each other. Although the maximum diameter $W_3$ of the tapered projection 51 is larger than the inside diameter $W_2$ of the sleeve 50, the projection 51 can be inserted through the sleeve 50 if the slit 35*a***is closed.

Figure 8A:
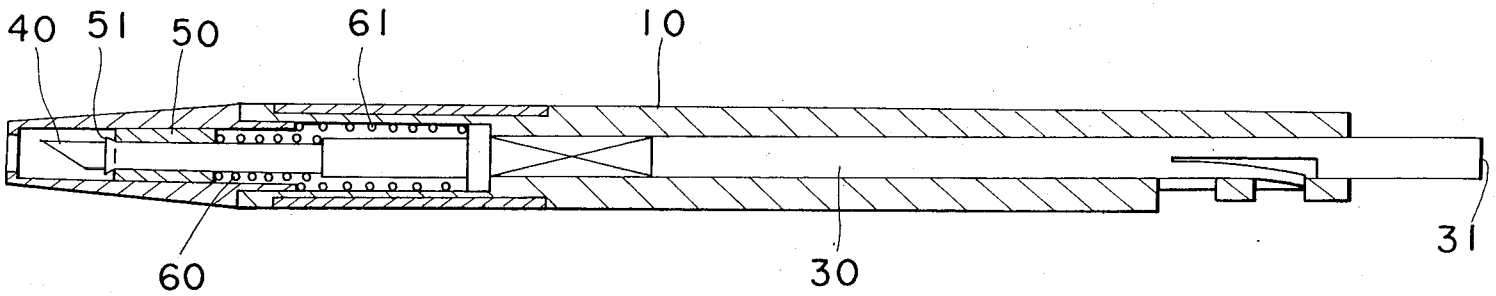
FIGS. 8(*a*) to 8(*c*) are longitudinal sectional views of the cutter in different positions.
Figure 8B:
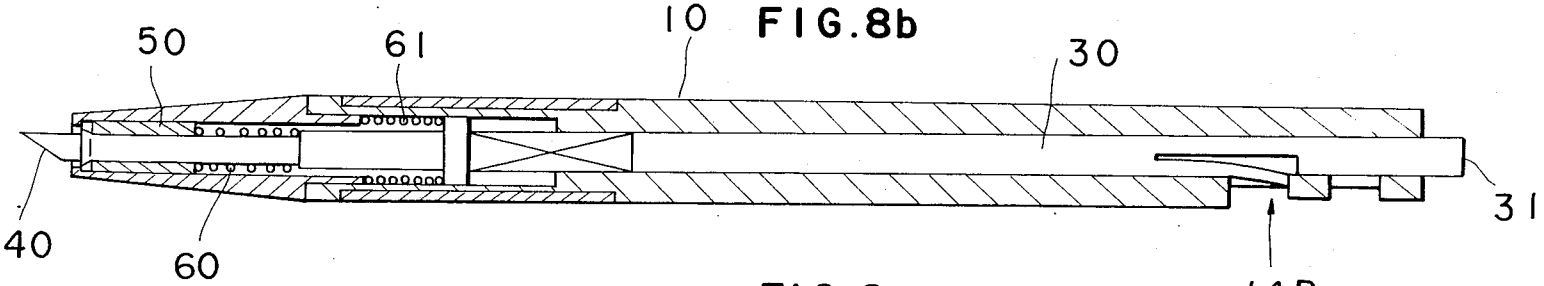
Figure 8C:
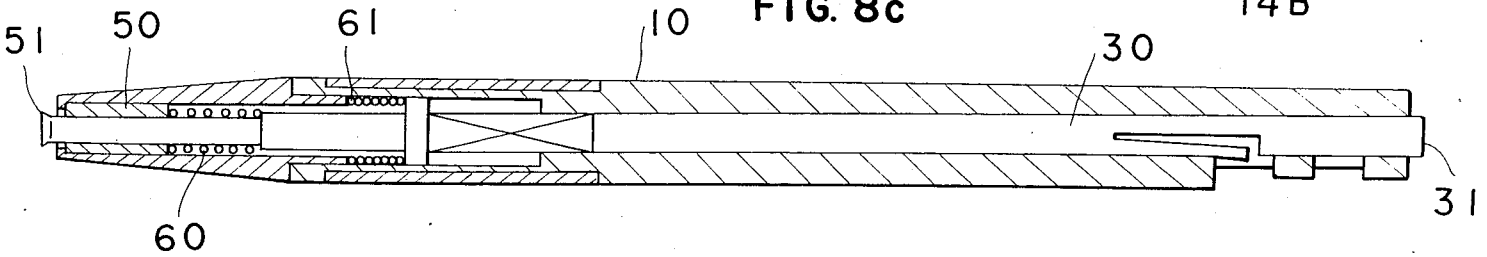

A coiled spring 60 is disposed about the first end portion 35 of the shank between its middle portion 30A and the sleeve 50, as shown in FIG. 7. The middle portion 30A and the first end portion 35 have therebetween a shoulder which holds one end of the spring 60. When the sleeve 50 is inserted about the shank portion 35, a force may be applied to the projection 51 to close the slit **35*a* to enable its insertion into the sleeve 50, as hereinabove stated. After the sleeve 50 has been fitted, the blade 40 is inserted into the slit 35*a*. As the spring 60 urges the sleeve 50 against the tapered projection 51, the sleeve 50 exerts pressure on the end of the shank portion 35 in the direction in which the slit 35*a* is closed. Thus, the shank portion 35 and the sleeve 50 grip the blade 40 rirmly. Another coiled spring 61 is disposed about the middle portion 30A of the shank 30 between the inner end 25 of the cap 20 and the diametrically enlarged portion 34 of the shank 30, as shown in FIGS. 8(*a*) to 8(*c*)**.

The use of the cutter constructed as hereinabove described will be described with reference to FIGS. **8(*a*) to 8(*c*). Referring first to FIG. 8(*a*), the cutter is shown in its first position. The pushbutton 31 is in its outermost position and the shank 30 is in its first position in which its enlarged portion 34 is in its retracted position. It is held by the spring 61 in contact with the shoulder 16 of the main body 10 and the blade 40 is held in its retracted position within the cap 20. When the cutter is not used, the blade 40** is kept in its retracted position which ensures safety when the cutter is carried about.

If the pushbutton 31 is pressed by overcoming the force of the spring 61, the shank 30 is axially moved along the holder body 10 and the sleeve 50 is also axially moved along the cap 20. As a result, the cutter takes its second position in which the blade 40 has its cutting edge 40A projecting from the cap 20, as shown in FIG. **8(*b*). When the cutter is in its first position, the projection 32 on the shank 30 stays in the first aperture 14A of the holder body 10. When the pushbutton 31 is pressed, the projection 32 leaves the first aperture 14A and moves elastically into the second aperture 14B, as shown in FIG. 8(*b*). The push-button 31 can be released as soon as the projection 32 has slipped into the second aperture 14B. Although the spring 60 urges back the shank 30, the projection 32 prevents the backward movement of the shank 30 and thereby maintains the blade 40** in its projecting position in which the cutter can be used for cutting various kinds of objects.

The slit **35*a* has a bottom which prevents the longitudinal retraction of the blade 40. The sleeve 50 is pressed by the spring 60 against the tapered projection 51 to thereby close the slit 35*a*. Therefore, the blade 40 can be gripped firmly by the shank portion 35. As the middle part 33 of the shank 30 having a square cross-section is fitted in the middle portion 13 of the holder body 10 having a complementarily square cross-section, the shank 30 can be prevented from rotation relative to the holder body 10. Therefore, there is no angular displacement of the blade 40 relative to the holder body 10**, but the cutter can be used very reliably.

The blade 40 is easy to change. When it is necessary to change the blade 40, the pushbutton 31 is further pressed to its innermost position. The cutter is brought to its third position in which the projection 51 on the shank portion 35 projects from the cap 20, as shown in FIG. 8(*c*). As the sleeve 50 abuts on the shoulder 21 of the cap 20, it is disengaged from the projection 51 and no longer exerts any pressure acting to close the slit 35*a*. The blade 40 can now be removed from the slit 35*a* easily. If it has been changed to a new blade, the projection 32 is pressed and the shank 30 is drawn back any the spring 61 to retract the blade 40 into the cap 20.

Although the invention has been described with reference to a preferred embodiment thereof, it is to be understood that variations or modifications may be easily made by anybody of ordinary skill in the art without departing from the scope of this invention which is defined by the appended claims. For example, a variety of modifications may be made to the mechanism for moving the blade 40 out of, or back into, the holder 1. It is possible to employ various mechanisms which are already used in mechanical pencils or ballpoint pens. The pushbutton mechanism is not essential, but it is alternatively possible to provide the holder 1 with a rotatable portion of which the rotation is converted to the linear motion of the shank. Although the shank portion 35 has been described as having a single planar slit for supporting the blade, it is alternatively possible to provide, for example, a cross-shaped slit having its center on the longitudinal axis of the shank portion 35.

The cutter of this invention has many advantages as hereinabove stated. It ensures a high degree of safety, as the blade is easily retractable into the holder. There is no danger of injury when it is carried about or put aside. The combination of the slit, the tapered projection on the shank and the sleeve provides a highly reliable support for the blade which prevents any displacement of the blade, even though it is subjected to a considerably large force when the cutter is used. When tne blade is further moved from its cutting position, the sleeve is prevented from any further movement and ceases to exert pressure on the blade. Therefore, the blade can be changed easily without requiring the holder to be disassembled.

What is claimed is:

1. A cutter comprising:

a tubular holder;

a shank disposed in said holder movably axially of said holder;

a blade supported removably on one end of said shank, said shank having an axially extending slit terminating at said one end thereof for supporting said blade therein and a tapered portion having an outside diameter decreasing gradually from said one end of said shank, said blade being movable from one of its retracted, cutting and replacement positions to another with the movement of said shank;

a sleeve fitted about said shank adjacent to said one end thereof and having one end facing said tapered portion;

resilient means provided on said shank for urging said one end of said sleeve into contact with said tapered portion, said sleeve being axially movable with the movement of said shank; and means provided about said one end of said shank for preventing the movement of said sleeve upon movement of said blade to said replacement position thereof.

2. A cutter as set forth in claim 1, wherein said shank has another end projecting from said holder and defining a pushbutton for moving said shank axially and a coiled spring is provided in said holder for urging said shank to maintain said blade in said retracted position.

3. A cutter as set forth in claim 1, wherein said holder has a rotatable portion which can be rotated about its own axis for moving said shank axially.

4. A cutter as set forth in claim 1, wherein said resilient means is a coiled spring having one end fastened to the other end of said sleeve.

5. A cutter as set forth in claim 4, wherein said holder comprises a main body and a cap connected removably thereto, said sleeve being located within said cap, and said preventing means is a shoulder formed in said cap at one end thereof on the opposite side of said sleeve from said resilient means, said one end of said sleeve being engageable with said shoulder upon movement of said blade to said replacement position thereof.

* * * * *